United States Patent [19]

Slayman

[11] 4,335,481

[45] Jun. 22, 1982

[54] MOTOR DRIVEN WASHING, POLISHING WAND

[76] Inventor: Glen E. Slayman, 120 Pinkerton Dr., Beaver, Pa. 15009

[21] Appl. No.: 140,982

[22] Filed: Apr. 17, 1980

[51] Int. Cl.[3] ..... A46B 13/04

[52] U.S. Cl. ..... 15/29; 15/97 R

[58] Field of Search ..... 15/97 R, 24, 28, 29; 51/170 T; 173/168, 169

[56] References Cited

U.S. PATENT DOCUMENTS

| | | | |
|---|---|---|---|
| 1,507,349 | 9/1924 | Franz | 15/29 |
| 1,604,500 | 10/1926 | Tannenbaum | 15/29 |
| 2,226,145 | 12/1940 | Smith | 15/29 |
| 3,387,312 | 6/1968 | Westphal | 15/97 R |
| 3,638,264 | 2/1972 | Walton | 15 29 X/ |
| 4,060,870 | 12/1977 | Cannarella | 15/24 |

FOREIGN PATENT DOCUMENTS

| | | | |
|---|---|---|---|
| 836084 | 4/1952 | Fed. Rep. of Germany | 15/29 |

*Primary Examiner*—Edward L. Roberts

*Attorney, Agent, or Firm*—Martin P. Hoffman; Mitchell B. Wasson; Charles W. Fallow

[57] ABSTRACT

A battery operated, rotary powered washing and polishing wand is disclosed which has an elongated rigid tubular shaft and a coaxial flexible drive shaft which permits the incorporation of a bend in the shaft and the swiveling of a disc mounted at the bent end of said shaft. Fluid can be supplied through the interior of said shaft to the disc for discharge therefrom along with aspirated additives such as soap.

6 Claims, 8 Drawing Figures

MOTOR DRIVEN WASHING, POLISHING WAND

BACKGROUND OF THE INVENTION

1. Field of the Invention

This invention relates to a rotary powered, hand held wand for remote washing or polishing of surfaces. More particularly, the invention relates to a wand having a rotary disc mounted thereon wherein the disc is provided with various contact surfaces for brushing, wiping or polishing a remote surface and wherein fluids and additives are supplied through said wand to assist in the surface treatment of said wand.

2. The Prior Art

Various washing wands, brushing devices and polishing implements have been set forth in the prior art. These devices have included devices having tubular shafts connected to conventional water supplies, battery powered rotary brushes and hydraulic motor operated washing implements. However, these devices lack several important features, such as flexible drive means, interchangeable rotary disc surfaces, balanced weight placement for easy manual operation and other improvements incorporated in the present invention.

Several prior art devices exhibit individual aspects of relevant washing and brushing implements. In U.S. Pat. No. 1,604,500 to Tannenbaum a power driven fountain brush is disclosed. The device consists of a complex wand element and a motor placed toward the remote end of the hand held implement. A soap reservoir is also placed at the remote end of the wand to further concentrate the weight of the device away from the most easily carried placement. U.S. Pat. No. 2,682,067 to Coleman describes a rotary paint brush with a flexible drive means. However, this device suffers from a flexible conduit which prevents remote operation. The device also requires heavy floor mounted support apparatus. In U.S. Pat. No. 3,638,264 to Walton, a rotary brush is shown with a motor and reservoir located at the handle position of the implement. The device has a hollow rigid drive shaft which does not allow the brush head to have any freedom of movement. A battery operated, non-remote, rotary brush is shown in U.S. Pat. No. 4,168,560 to Doyel. Other prior art devices of interest are shown in U.S. Pat. No. 1,625,792 to Carrington, U.S. Pat. No. 3,272,200 to Friedman, U.S. Pat. No. 3,387,312 to Westphal, U.S. Pat. No. 4,151,624 to Montalvo, British Pat. No. 584,273 to Crawford, French Pat. No. 608,259 to Sconblum and French Pat. No. 1,062,065 to Chollet.

All of these devices suffer from deficiencies of construction, balance and ease of use. A simple structure is necessary in order to keep the overall weight of such a hand-held device at a reasonable level. Additionally, that weight which is necessary in such a device needs to be placed where it is easily carried during use of the device. The devices of this type should include means for contacting variously angled surfaces at remote locations from the operator. These considerations and the recited deficiencies are improved upon in the structure of the present invention and significant advantages are realized as will be apparent in the discussion set forth below.

SUMMARY OF THE INVENTION

The present invention comprises a washing and polishing wand which is hand-held and yet capable of contacting remote and uneven surfaces for effective cleaning and treating with a rotary contact surface affixed to the end of the wand. The wand has an elongated rigid tubular shaft through which fluid, such as water, is carried to the contact surface. The shaft also carries a flexible rotary drive cable coaxially within its interior. The cable transmits rotary power from a motor mounted at the operator end of the wand to the contact surface which consists of a brush or buffing cover. The wand has an inlet coupling for introducing water from an outside source to the interior of the tubular shaft of the wand. A soap or other additive reservoir is carried on the intermediate portion of the wand and dispenses such soap or additive into the water stream by the aspirating action of a venturi at the inlet fixture of the reservoir and the wand. The contact surface comprises a flexible disc attached to the flexible drive cable so that it can rotate and swivel at the terminal end of the wand's shaft. The terminal end of the shaft has a bend created in it at an obtuse angle with respect to the remainder of the shaft.

It is an object of the present invention to provide a lightweight, self-contained washing and polishing wand which uses a conventional water supply.

It is another object of the present invention to have a wand with a rigid shaft and a bend in said shaft to facilitate contacting remote surfaces to be cleaned or treated with the wand.

It is an object of this invention to utilize a flexible cable to transmit rotary power through the bent shaft of the wand and to permit the flexible disc to swivel in its mounting.

It is yet another object of this invention to have a brush or polishing disc on the remote end of a wand which disc is free to swivel in order to accommodate varying surfaces to be contacted.

A further object of the present invention is to power the rotary disc of a washing and polishing wand by a safe battery-powered electric motor mounted at the operator end of the wand's shaft.

It is yet a further object of the present invention to mount said flexible cable coaxially within said shaft with a plurality of bushings which bushings allow the flow of fluid through apertures provided in said bushings.

The washing and polishing wand is described in greater detail below with reference to the following drawings, which show a preferred embodiment of the invention.

DETAILED DESCRIPTION OF THE PREFERRED EMBODIMENT

Figure 1:
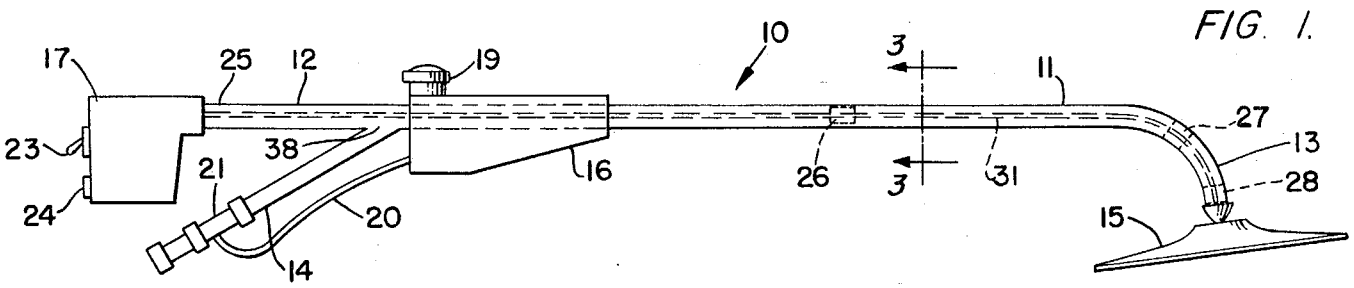
FIG. 1 is a perspective view of the apparatus embodying the present invention.

The structure and operation of the motor driven washing and polishing wand of the present invention is best described with reference to FIG. 1 and FIG. 2. The novel wand 10 consists of an elongated rigid tubular shaft 11 which is hollow throughout its length. The shaft has an operator end 12 and a terminal end 13. The operator end 12 of the shaft 11 is the portion of the wand which is held by the person using the wand during washing or polishing operations. The terminal end 13 of the shaft 11 is the portion of the wand which is remote from the operator during use and which is utilized to effectively reach distance surfaces for treatment with the wand by the operator. The terminal end 13 of the shaft 11 has a bend in its portion which is at an obtuse angle with respect to the remainder of the shaft. This bend in the terminal end of the shaft provides for easier contact of remote surfaces with the wand and its attached rotary disc 15.

A flow controlled fluid inlet, consisting of a water conduit 14 and a manually actuatable valve 22, is affixed, by welding 38 or other means, to the operator end of the shaft 11. The water conduit 14 allows for fluid communication from a conventional source of water 34 to the interior of the shaft 11. The water conduit, preferably, is joined to the shaft at its underside at an angle away from the terminal end 13 of the shaft 11. A reservoir 16 for soap or other additives is affixed immediately ahead of the water conduit 14 on the operator end 12 of the shaft 11.

The reservoir 16, preferably, completely encircles that portion of the shaft 11 on which it is supported. The reservoir 16 is provided with a capped fill inlet 19. This inlet 19 allows the reservoir 16 to be filled manually with concentrated soap or other additives which are mixed with the water introduced into the wand 10, and is adapted to provide threadable engagement with a standard water hose coupling in order that the reservoir can be rinsed of additive residues with water from such an attached hose.

The soap reservoir 16 dispenses its contents through a narrow gauge feed tube 20 to the water conduit 14. The dispensing action is accomplished by a combination of aspirating force and gravity. The aspirating force is supplied by the effect of water flow through the conduit 14, and particularly through a venturi or aspirator 21 connected by coupling 37 in the conduit 14 at the point of intersection of the feed tube 20 and the conduit 14. The amount of aspiration and the water flow can be controlled by the valve 22 upstream of the aspirator 21. This valve 22 allows the wand to be used with or without water or other cleaning fluids.

A motor casing 17 is affixed to the end of the operator portion 12 of the shaft 11. The motor casing 17 houses a self-contained rotary power source such as an electric motor 32 and gear reduction assembly which, in turn, is powered by a self-contained rechargeable battery 33. The casing is provided with an electrical switch 23 to control the electric motor and an electrical receptacle 24 for charging the battery 33 or operating the motor 32. The casing 17 is affixed to the operator end 12 of the shaft 11 by a threaded coupling 36. The electric motor 32 is connected to a flexible rotary power drive cable 31 by a motor shaft adaptor 35. The adaptor 35 accepts the electric motor's shaft end and a rotary power drive cable end in the adaptor's base. The ends are locked in the adaptor by set screws. The motor 32 supplies the rotational drive force for the rotary disc 15.

Figure 3:
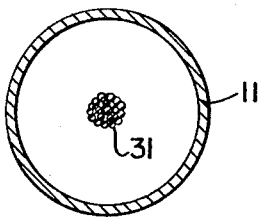
FIG. 3 is a cross-sectional view of the shaft of the apparatus shown in FIG. 1 taken along the line 3—3.
Figure 5:
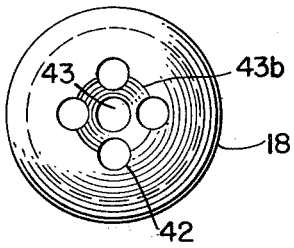
FIG. 5 is a view of the swivel head of the present invention taken along the axis of the head.
Figure 6:
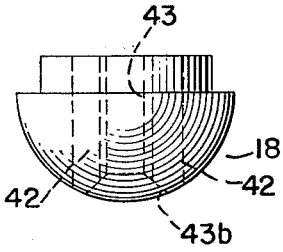
FIG. 6 is a side view of the swivel head of the present invention shown in FIG. 5.

The flexible rotary power cable 31 is fabricated from a woven steel cable. It runs coaxially through the entire interior length of the shaft 11 and transmits rotational drive force from the motor 32 to the disc 15. The cable 31 is supported in the axial center of the shaft 11, as shown in FIG. 3 by a series of bushings 25, 26, 27 and 28. The end of the cable 31 at the terminal end 13 of the shaft 11 is also supported in a swivel head 18 which is preferably fabricated of chromed steel. The swivel head 18 has an overall domed shape. The swivel head 18 closes off the terminal end 13 of the shaft 11 except for apertures in the head 18. As shown in FIG. 5 and FIG. 6, the swivel head 18 has a central axial aperture 43 through which the power cable 31 passes. A series of water ports 42 are radially arranged around the cable aperture 43. These ports 42 and the cable aperture 43 communicate with similar ports 30 and an aperture 46 in the flexible rotary disc 15, affixed to the end of the power cable 31. Sufficient tension is placed on the disc 15 by the cable 31 to keep the disc 15 frictionally engaged with the smooth, domed surface of the swivel head 18. This connection of the disc 15 to the swivel head 18 allows for swiveling freedom of the disc with respect to the entire wand 10, in addition to the free rotation of the disc 15 at the end of the wand 10. An ample swivel angle of the disc 15 is provided by the flexibility of the power cable 31 and the flared opening **43*b*** of the head aperture, best viewed in FIG. 6.

Figure 4:
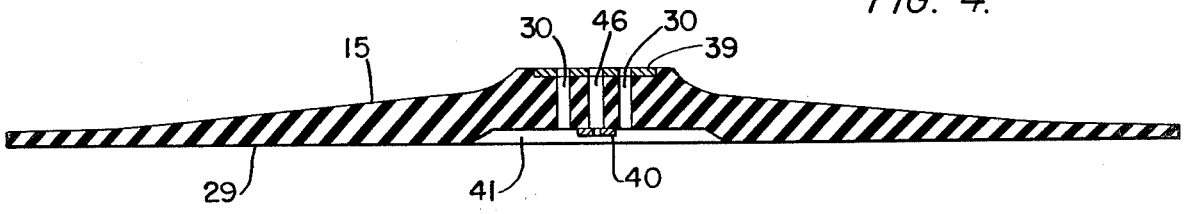
FIG. 4 is a fragmentary view, in partial section, of the rotary flexible disc of the subject invention.

As seen in FIG. 4, the flexible rotary disc 15 has metal washers 39, 40 located at either side of the fastening of the disc to strengthen the disc at this point. The disc is, preferably, made of an elastomeric material, such as rubber. The disc has a contact face 29 which is fitted with various contact appliances, such as a bristled brush, a polishing buffer or an abrasive surface paper. None of these optional articles are shown, but they are conventional in nature and are affixed to the flexible disc 15 by methods well within the knowledge of those practicing in the art. A depression 41 is located in the contact face 29 to prevent abrasion by the fastening elements to the surfaces being treated with the wand or the various contact appliances.

Figure 2:
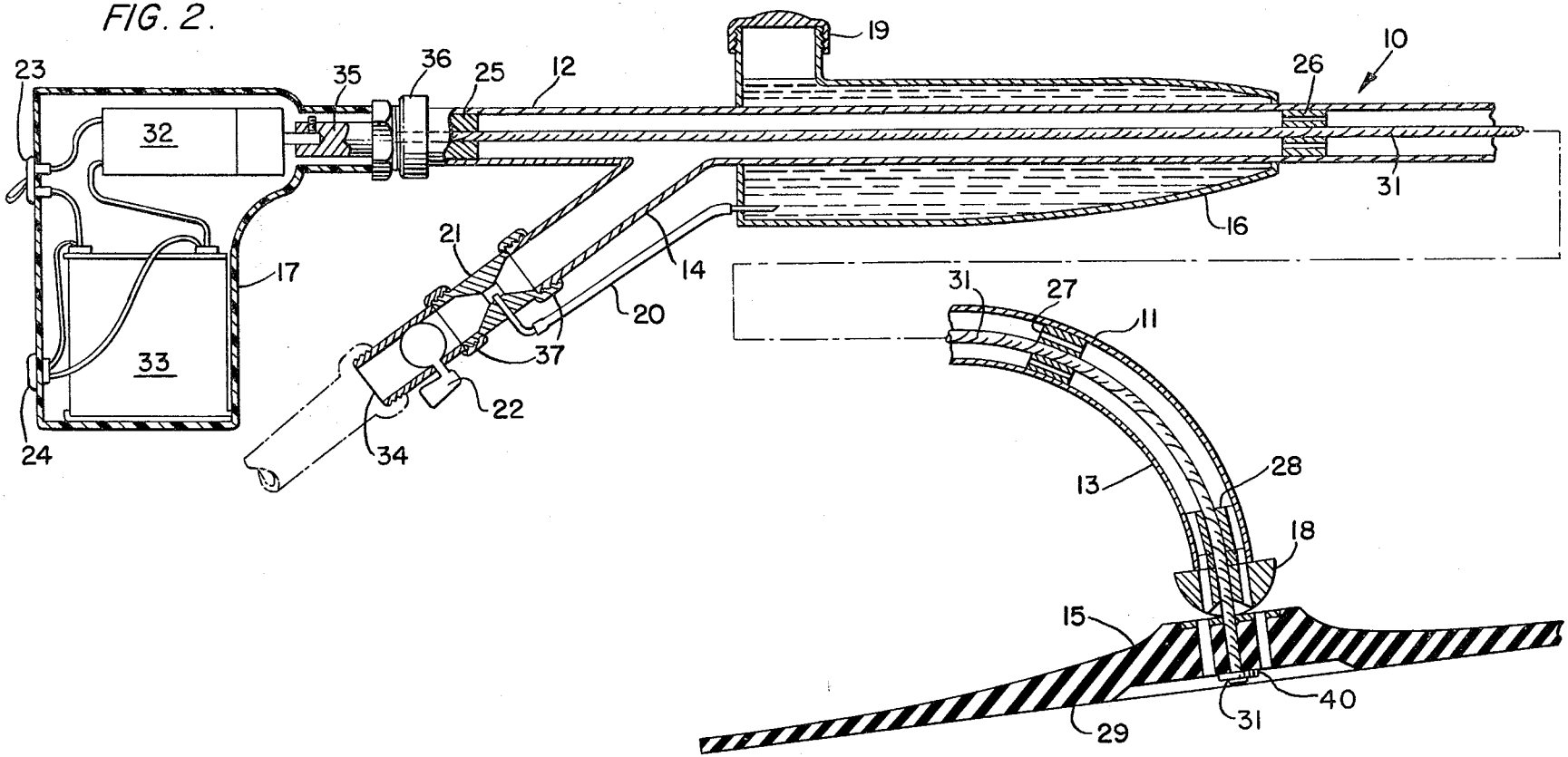
FIG. 2 is a side view, in section, of the apparatus of the present invention.
Figure 7:
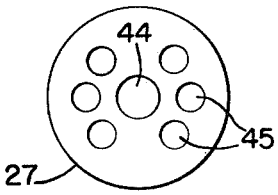
FIG. 7 is a view of a bushing of the present invention taken along the axis of the bushing.
Figure 8:
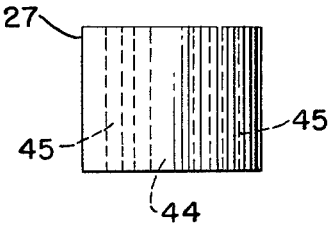
FIG. 8 is a side view of the bushing shown in FIG. 7.

As shown in FIG. 2, the flexible power cable 31 is supported at various points along the interior of the shaft 11 by bushings 25, 26, 27 and 28. These bushings are shown in detail in FIGS. 7 and 8. They consist of apertured, right cylindrical members which fit within the shaft's interior with a frictional fit. The power cable 31 passes through a central bore 44 and water or other fluids pass through a plurality of radially outwardly placed, parallel ports 45, which comprise apertures through the bushings.

In operation, the wand is supported manually by an operator at about the location of the soap reservoir. In a washing operation, the disc is fitted with a bristled brush and the reservoir is filled with concentrated soap. The operator throws the switch to the electric-motor to initiate rotation of the disc and then opens the valve in the water conduit to supply water to the rotating disc and brush assembly. Soap from the reservoir is automatically mixed with the water flowing through the wand by aspirating action of said water flow. The water and soap solution travels longitudinally through the interior of the shaft of the wand along the same path as and exterior to the flexible power cable. The water and soap solution is finally dispensed through the disc in a pulsating manner due to the periodic alignment and non-alignment of the ports of the swivel head and the disc. Alternately, wax or other additives can be placed in the reservoir. The wand can also be used without water or other fluids by simply closing the conduit valve and operating the rotary drive by itself.

Remote and irregular surfaces can be reached with the wand because of the angled terminal end of its shaft and the swiveling freedom of the disc. The device is well-balanced and easy to operate because the major weight of the apparatus, that is the motor, battery and reservoir, is located near the operator supported section of the wand. Finally, the wand is structurally simple and inexpensive to produce due to the coaxial placement of the flexible drive cable within the same shaft which delivers water or other fluids to the rotary disc.

The preferred embodiment of the invention has been set forth above, but the full scope of the invention is delineated by the claims that follow.

I claim:

1. A manually supportable washing and polishing wand which is operated in cooperation with a conventional water supply comprising:

(a) an elongated rigid tubular shaft having an operator end and a terminal end provided with a bend at the terminal end of said shaft;

(b) a rotary flexible disc positioned at the terminal end of said shaft and adapted to receive various contact appliances;

(c) a self-contained rotary power source located at the operator end of said shaft opposite said disc for supplying rotational drive force for said disc;

(d) a flow controlled fluid inlet connected to said tubular shaft near the operator end of said shaft for supplying fluid through said shaft to said disc;

(e) a reservoir supported on said shaft with means for communicating from the interior of said reservoir to the interior of said shaft;

(f) a plurality of bushings contained within said shaft;

(g) a flexible power cable connected at its one end to said rotary power source and at its other end to said rotary flexible disc and positioned coaxially within said tubular shaft by said bushings for transmitting rotational drive force from said power source to said disc while simultaneously allowing fluid flow longitudinally exterior to said cable and within said shaft; and (h) means mounting the flexible rotary disc to provide freedom to swivel on the terminal end of said shaft.

2. The invention of claim 1, wherein said means mounting the flexible rotary disc comprises:

(a) a swivel head positioned between said terminal end of said shaft and said flexible disc, (b) said swivel head having a domed surface adjacent said flexible disc.

3. The invention of claim 2 wherein (a) said swivel head has a plurality of ports therethrough for passing fluid from said shaft to said flexible disc, and (b) the flexible disc has a plurality of ports therein for passing fluid from said swivel head ports through said disc to a contact appliance.

4. A manually supportable washing and polishing wand comprising:

(a) an elongated rigid tubular shaft having an operator end and a terminal end provided with a bend at the terminal end of said shaft;

(b) a flexible disc rotatably positioned at the terminal end of said shaft and adapted to receive various contact appliances;

(c) a self-contained rotary power source located at the operator end of said shaft opposite said disc for supplying rotational drive force for said disc;

(d) a fluid inlet connected to said tubular shaft near the operator end of said shaft for supplying fluid through said shaft to said disc;

(e) a reservoir supported on said shaft with means for communicating from the interior of said reservoir to the interior of said shaft;

(f) a flexible power cable connected at its one end to said rotary power source and at its other end to said rotary flexible disc; and (g) a plurality of bushings supported within said shaft, each bushing having a central aperture through which said cable extends; and (h) each bushing further having a plurality of ports for allowing fluid to flow freely along the shaft from said inlet to said disc.

5. The invention of claim 4 comprising:

(a) means mounting the flexible rotary to provide freedom to swivel on the terminal end of said shaft;

(b) said means mounting the flexible rotary disc comprising a swivel head positioned between said terminal end of said shaft and said flexible disc, and (c) said swivel head having a domed surface adjacent said flexible disc.

6. The invention of claim 5 wherein (a) said swivel head has a plurality of ports therethrough for passing fluid from said shaft to said flexible disc, and (b) the flexible disc has a plurality of ports therein for passing fluid from said swivel head ports through said disc to a contact appliance.

* * * * *